United States Patent [19]

Tin

[11] Patent Number: 4,928,778

[45] Date of Patent: May 29, 1990

[54] REMOTE CONTROL CAR STARTER

[75] Inventor: Joshua K. Tin, Scarborough, Canada

[73] Assignee: Remote Automation & Control Electronics Inc., Scarborough, Canada

[21] Appl. No.: 131,998

[22] Filed: Dec. 11, 1987

[51] Int. Cl.[5] ..... F02N 11/08

[52] U.S. Cl. ..... 180/167; 123/179 B; 290/38 C; 180/287

[58] Field of Search ..... 180/167, 287; 123/179 B, 179 BG; 290/38 C, 38 E, DIG. 3; 307/10 R, 10 AT; 340/63, 539, 696, 825.31, 825.56, 825.69

[56] References Cited

U.S. PATENT DOCUMENTS

| | | | |
|---|---|---|---|
| 4,334,221 | 6/1982 | Rosenhagen et al. | 180/167 |
| 4,413,261 | 11/1983 | Greenberg | 340/825.69 |
| 4,674,454 | 6/1987 | Phairr | 180/167 |
| 4,754,255 | 6/1988 | Sanders et al. | 340/825.69 |

FOREIGN PATENT DOCUMENTS

| | | |
|---|---|---|
| 689071 | 6/1964 | Canada . |
| 689528 | 6/1964 | Canada . |
| 990829 | 6/1976 | Canada . |
| 1025085 | 1/1978 | Canada . |
| 1130426 | 8/1982 | Canada . |

*Primary Examiner*—David M. Mitchell
*Assistant Examiner*—Richard Camby
*Attorney, Agent, or Firm*—R. Neil Sudol; Henry D. Coleman

[57] ABSTRACT

It is known to remotely control an automobile component and like devices. However, security, to protect against unauthorized control, and the user's ignorance of the condition of the remotely controlled component, remain problems. This invention provides a security code mechanism to protect against unauthorized communications from controlling the component; and two way communications between the user's remote controller and the component, so that the user is informed of the condition of the controlled component.

34 Claims, 8 Drawing Sheets

REMOTE CONTROL CAR STARTER

BACKGROUND OF THE INVENTION

1. Field of Invention

This invention relates in general to remote controllers, and more specifically, to remote control engine starters.

2. Prior Art

Engines, and especially, internal combustion engines, are extensively employed to operate consumer machines, such as automobiles and lawn mowers, and industrial machinery, such as cranes and lifts. Engines are also common in industrial settings, such as irrigation systems and oil well systems.

It is advantageous in many circumstances to start an automobile engine or accessory, such as an air conditioner or heater, by remote means from the user's residence or business. Beyond general convenience and comfort for the user during the remote start, a pre-cooling or pre-warming period is particularly advantageous for the elderly, infants and those with poor or sensitive health so they may enter into a tolerable atmosphere. Additionally, in the winter, a warm-up period would facilitate the manual removal of ice and snow from the automobile's exterior. For diesel engine vehicles operating in very low temperatures which require periodic starting for battery maintenance, remote control would eliminate the requirement of heated enclosures, heating accessories, or the periodic personal attendance of maintenance crews to start and stop the engines. In industrial settings, remote operation of machinery offers safety (for example, in the case of heavy load carrying machines) and efficiency (remote viewing for better perspective of operation).

Remote control starters are disclosed in the prior art: Canadian patent #990,829 (Lessard), Canadian Patent #689,071 (Naish), Canadian Patent #689,528 (Naish), Canadian Patent #1,130,426 (Hildreth et al) and Canadian Patent #1,025,085 (Bucher).

SUMMARY OF INVENTION

According to the present invention, there is provided a system for remotely controlling a device with a power source and a component powered thereby, the system comprising a mainset, mounted at any suitable location on the device, and a handset operable by a user. The handset includes handset code means for generating a security code and a command code for controlling the component, both selectable by the user; handset transmission means, coupled to and responsive to said handset code means, for transmitting said security code and command code; handset reception means for receiving a feedback code transmitted from said mainset, indicative of the condition of said component controlled in response to said command code, handset indicator means, coupled to said handset reception means and responsive to said transmitted feedback code; a power source for powering the handset. The mainset includes: mainset reception means for receiving said command code and security code transmitted from said handset transmission means; mainset encoding means for defining a preselectable mainset security code; mainset control means, coupled to and responsive to said mainset reception means and said mainset encoding means, having verification means for effecting a verification that said transmitted security code matches said mainset security code, where said mainset control means is controllingly coupled to said component upon said match; mainset feedback means, coupled to and responsive to the condition of said component, for generating a feedback code indicative of said condition; mainset transmission means, coupled to and responsive to said mainset feedback means, for transmitting said feedback code to said handset reception means; and the mainset being adapted to be coupled to the power supply.

Although the principles of the present invention may be included in various devices employing internal combustion engines, and is particularly useful for automobiles, the present invention has applications elsewhere. It may be fully integrated into known systems or may be constructed as a separate device with appropriate interfaces for installation or attachment to known systems.

BRIEF DESCRIPTION OF THE DRAWINGS

A preferred embodiment of the invention will now be described in conjunction with the following drawings, in which.

DETAILED DESCRIPTION OF THE PREFERRED EMBODIMENT

A preferred embodiment will be described with reference to a remote controller for an automobile.

Figure 1:
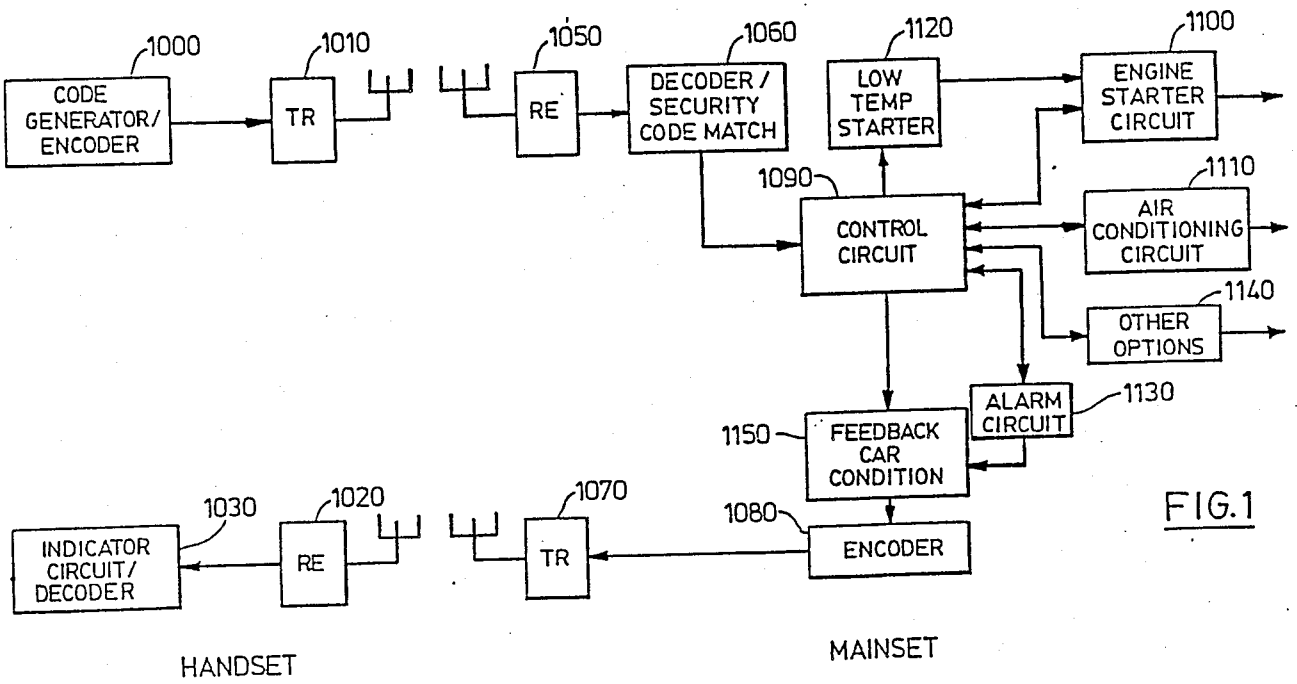
FIG. 1 is a simplified functional block diagram of the system of the invention.

With reference to FIG. 1, the invention comprises a handset and a mainset. The handset has a code generator and encoder 1000 for generating an encoded security or secret code and a command code, and a transmitter 1010 for transmitting said codes to the mainset to control defined components of the automobile. The handset also has a receiver 1020 for receiving a feedback code from the mainset and indicator circuit and decoder 1030 responsive to said feedback code. In this way, the user may, through the handset, remotely access the mainset, if the transmitted security code is accepted by the mainset, and therethrough control, with an appropriate command code, a component of the automobile; and subsequently, the user may learn, through the handset, of the condition of said component. Turning to the mainset, the transmission and reception components and the various automobile components are generally organized about control circuit 1090, as follows.

For reception of a transmitted code from the handset, there is a receiver 1050 and associated decoder and security or secret code matcher 1060. For transmission of the feedback codes to the handset, the mainset has a transmitter 1070 and associated encoder 1080.

Secret code matcher 1060 holds a preset secret or security code and matches it against the received secret code from the handset. On a match, a subsequent command code transmitted to the mainset will be passed on, by secret code matcher 1060, to the control circuit 1090. Control circuit 1090 controls one of perhaps several automobile components according to the received command code: starting engine 1100, starting air conditioner 1110, activating automatic low temperature engine starter 1120, activating an alarm circuit 1130; and other options, like activating a heater fan or fuel injector, this last group of options generally designated, for simplicity of illustration, as 1140. The condition of components of the automobile (for example, the engine has successfully been started, the engine has stopped, the alarm system has detected an unauthorized entry, etc.) is determined by the circuits for those options and is transferred to the feedback circuit 1150 indirectly through the control control circuit 1090. Feedback circuit 1150 then transmits the condition to the handset through encoder 1080 and transmitter 1070. The appropriate indicator circuit 1030 on the handset is then activated to inform and alert the user to consider further action, if appropriate.

It will be appreciated that the relationship and organization of the blocks shown in FIG. 1 are for simplicity of illustration. Alternatively, for example, the condition of the automobile components may be transferred to the feedback circuit 1150 directly. Or, the secret code matcher, identified as 1060 in FIG. 1, may be part of control circuit 1090. The major components of the system of a preferred embodiment and their relationship having been described, reference is now made to FIGS. 2, 3, and 4, which illustrate the logic flow of several aspects thereof.

Figure 2:
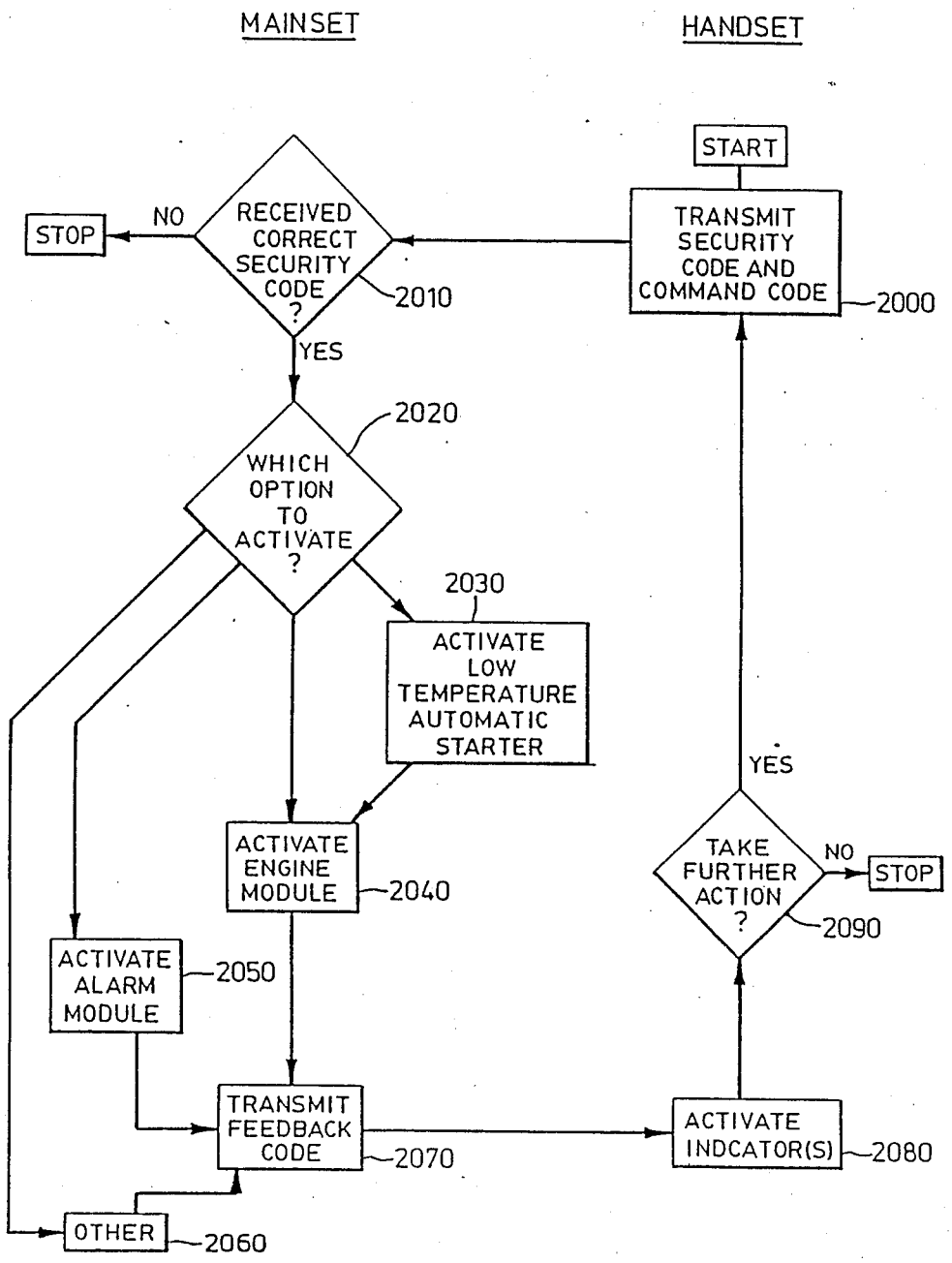
FIG. 2 is a logic flow diagram relating to the overall processes of the system of the invention.

FIG. 2 shows the main features of the logic flow between the handset and mainset. To initiate communication, a security code and a command code must be transmitted from the handset to the mainset (process block 2000). The security code received will be matched against a preset security code (decision block 2010). Upon verification of a match, the command code is acted upon and the appropriate process module is activated (decision block 2020 and process blocks 2030, 2040, 2050 or 2060). Their status is fedback to the handset (process block 2070) and the appropriate indicator on the handset is activated (process block 2080). Thereafter, the user has a choice of further action (decision block 2090), do nothing or remotely access the mainset, as before (process block 2000).

Two process modules, 2040 and 2050, the engine activate and the alarm activate, will be described next.

Figure 3:
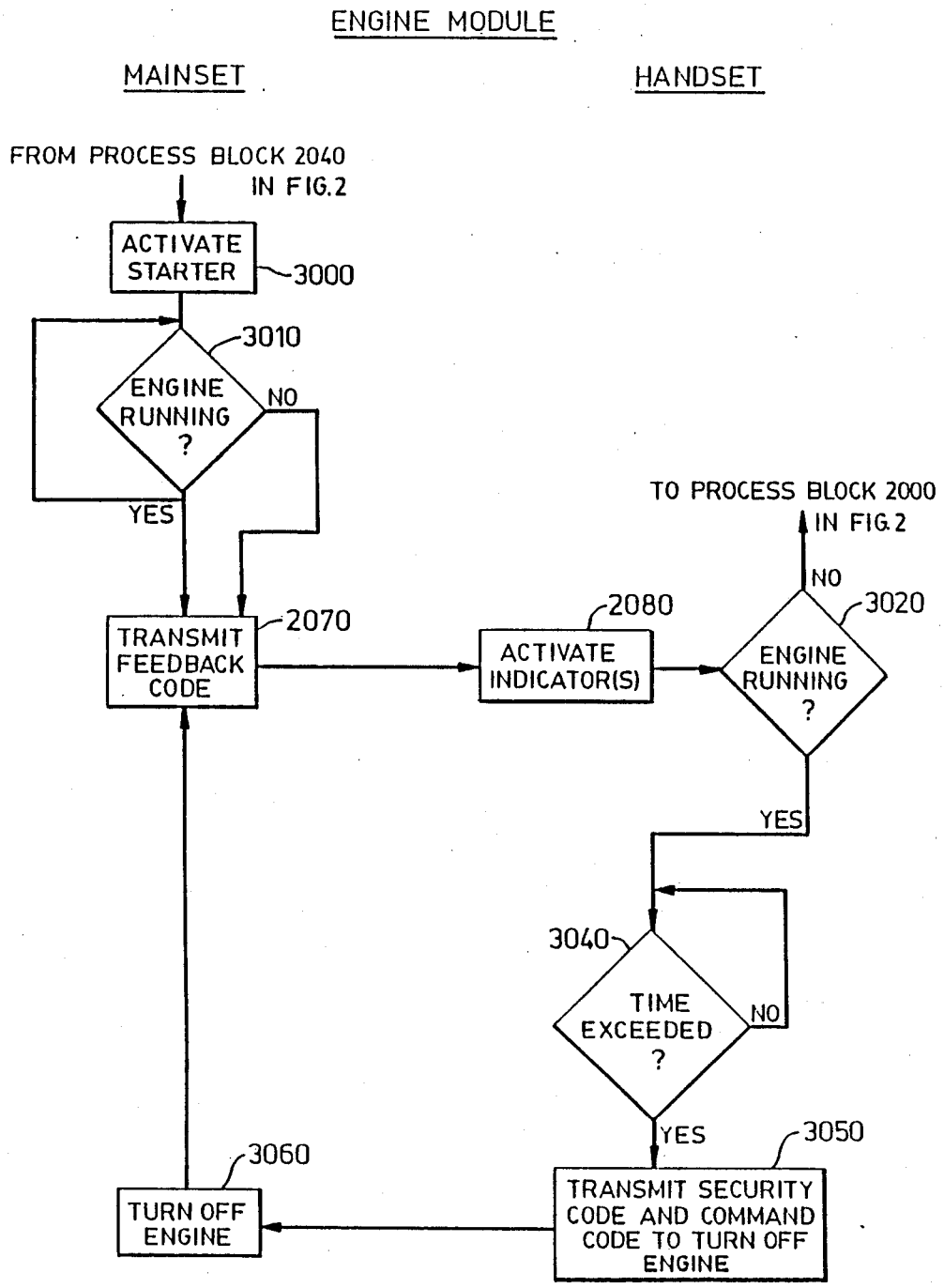
FIG. 3 is a logic flow diagram of the operation of the engine process module, in automatic turn off mode, of FIG. 2.

FIG. 3 illustrates the engine process module in automatic shutoff mode. The appropriate command code is received and acted upon (process block 3000). If the engine has not started (decision block 3010), an appropriate feedback code is transmitted to the handset and the appropriate indicator is activated (process blocks 2070 and 2080). Similarly, if the engine is running (decision block 3010), an appropriate feedback code is transmitted to the handset and the appropriate indicator on the handset is activated (process blocks 2070 and 2080). There is a wait (looping around decision block 3010) to detect if the engine has stopped running after a start; if it has, an appropriate feedback code is sent to the handset, as before.

If the engine has started (decision block 3020), a timer in the mainset is activated to determine if a preset time limit has been exceeded (looping around decision block 3040).

If the engine is still running and the preset time is exceeded, then the appropriate security code and command code to shut the engine off is automatically sent and the engine is turned off (process blocks 3050 and 3060), and an appropriate feedback code is sent to the handset, as before.

In case the engine has turned off before the preset time limit (decision block 3010), the appropriate indicator circuit is activated (process block 2070 and 2080), as before.

Figure 4:
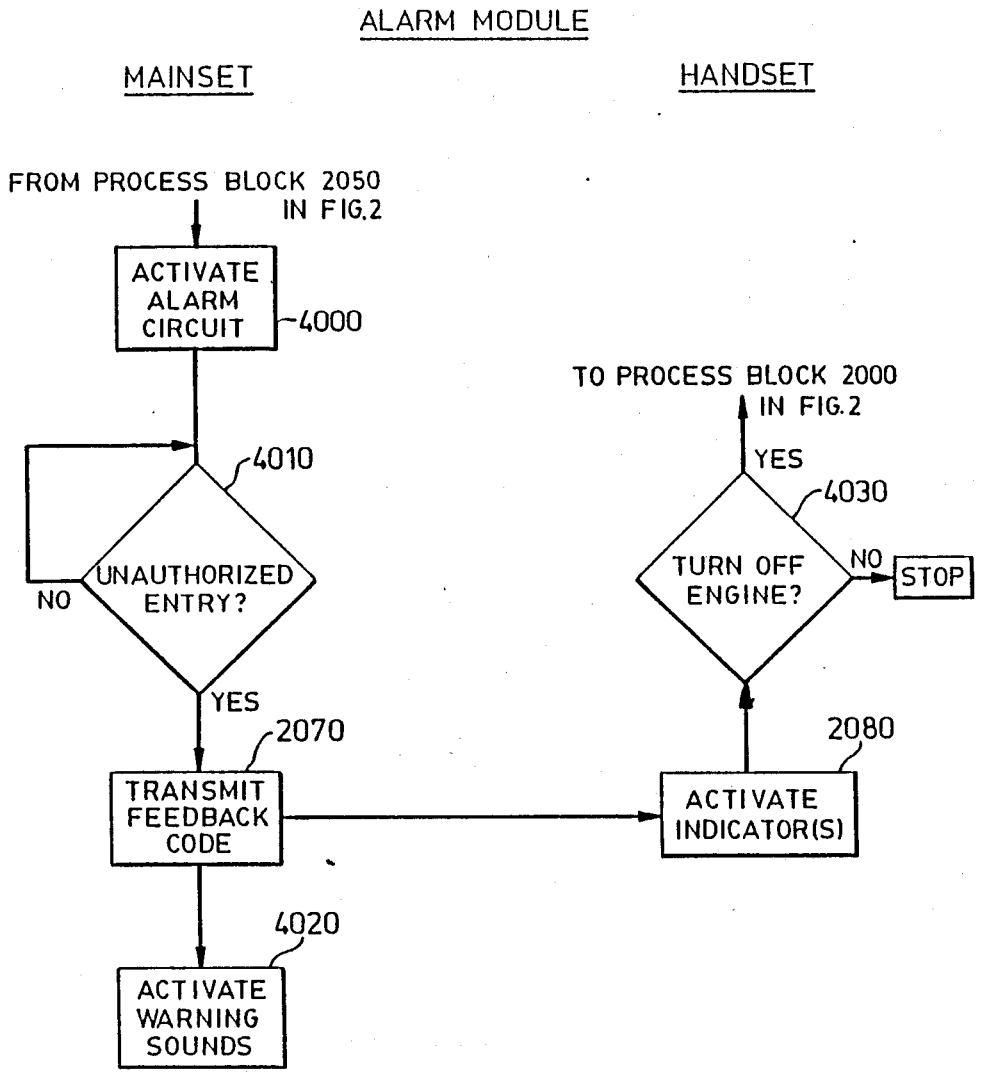
FIG. 4 is a logic flow diagram of the operation of the alarm process module of FIG. 2.

The alarm process module is illustrated in FIG. 4. The appropriate command code is sent from the handset and the alarm circuit is activated (process block 4000). There is a wait to detect a presumably unauthorized entry of the automobile (looping around decision block 4010) . On such an entry, a warning beeper is activated to scare off the entrant (process block 4020), and an appropriate feedback code is sent to the handset to activate the appropriate indicator (process blocks 2070 and 2080) to alert the user. The user may react by turning off the engine (decision block 4030).

A description of the electrical circuit embodiment will now be made in conjunction with FIGS. 5 to 8, with reference to the following example: a seven digit security code (3663007), with the following set of one digit command codes: '0' to ascertain the condition of selected options of the automobile, '1' to start the engine, '2' to turn off the engine, '3' to activate the heater fan, '4' to activate an automatic garage door opener, '5' to activate the alarm circuit, '7' to activate the low temperature automatic starter, and '8' to initiate a fuel advance circuit to inject fuel into the carburetor. With a multi-digit base ten security code, the total number of possible security codes is very large and accordingly, the likelihood of unauthorized access to the mainset is correspondingly small.

HANDSET

Transmission/reception

Figure 5:
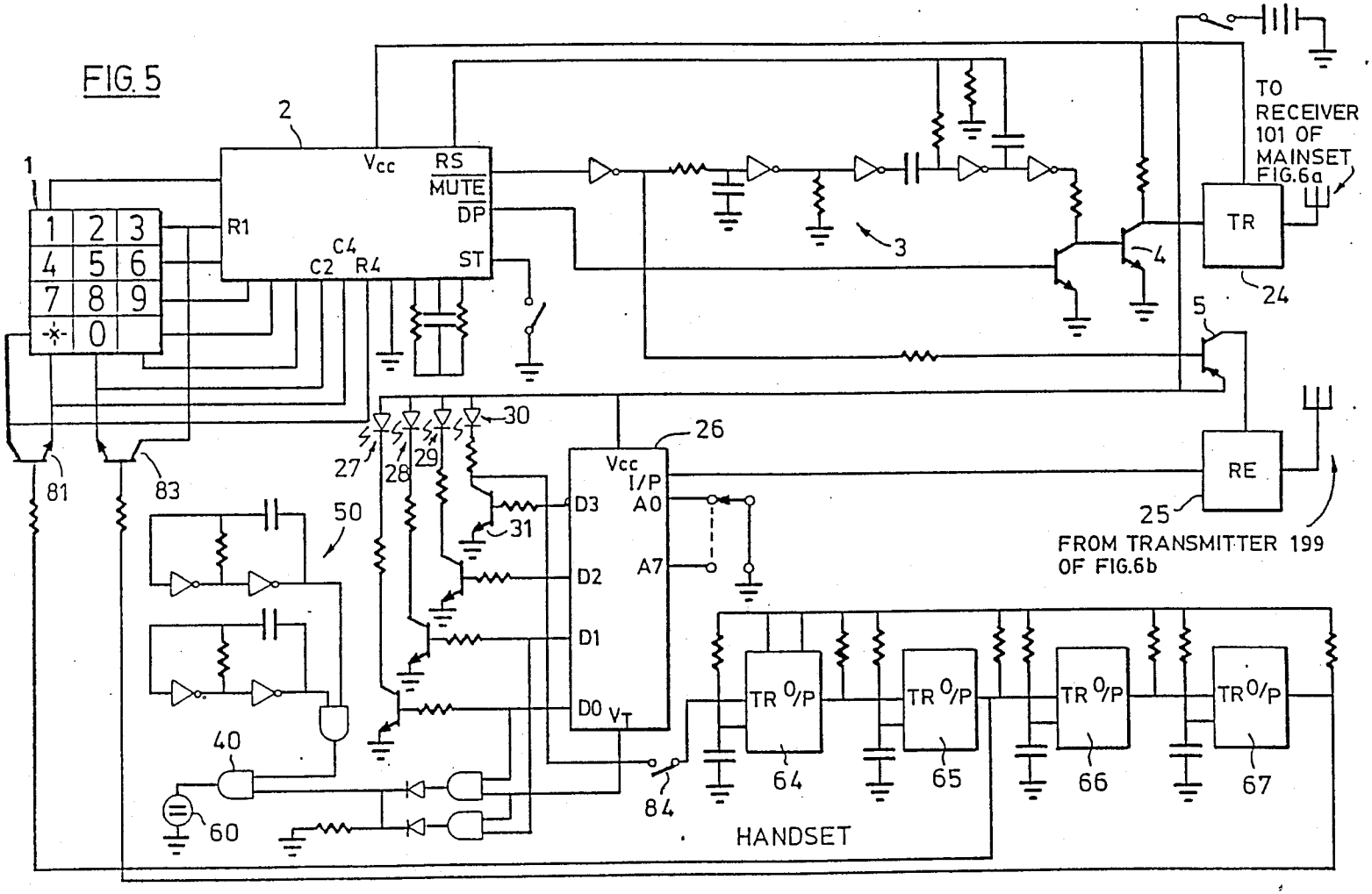
FIG. 5 is an electric schematic diagram of the handset.

With reference to FIG. 5, for transmission, there is a conventional multi-digit keyboard 1, with an auxiliary digit key '*', driving a pulse generator 2, with associated circuitry. Momentary actuation of a key on keyboard 1 will send the appropriate pulses from generator 2, through a delay circuit, generally designated as 3, then through transistor 4 and then to transmitter 24 for transmission. Transmitter 24, as well as the other transmitters and receivers mentioned herein, may be those of conventional construction, and may be radio transmitters and receivers tuned to the same freuqency or frequencies, wire-connected, or employ any other suitable mode.

Delay circuit 3, comprising inverter circuits, will reset pulse generator 2 after transmission of the pulses. While pulse generator 2 outputs pulses, [MUTE] goes low and keeps the first inverter of delay circuit 3 high to maintain transistor 5, the power source of receiver 25, at cut off. Accordingly, receiver 25, during transmission by transmitter 24, can not receive any signals, whether from the handset transmitter 24 or any other transmitter, or any spurious signals from the environment. When pulse generator 2 completes transmission, output [MUTE] goes high and accordingly receiver 25 is returned to receiving status.

The security code may be programmably stored by the user in a conventional auxilliary memory (not shown) associated wth keyboard 1, where the actuation of the '*' key will retrieve the memorized security code, as if the individual digits of the security code were manually keyed in, as described above.

For reception of a feedback code from the mainset, a signal received by receiver 25 is decoded by ten-to-four decoder 26. There is a mechanism to ensure that a signal received is, or is likely, the feedback code coming from the associated mainset, as follows.

Handset decoder 26 and mainset encoder 181, discussed in more detail below, are compatible and complementary components, and the A0 to A7 terminals of handset decoder 26 are grounded or raised in the same pattern as the corresponding A0 to A7 terminals of mainset encoder 181. In this way, only the pulses sent by such a complementary encoder 181 will have a pulse width acceptable for proper processing by decoder 26. Decoder 26 output VT goes high only when the signals input to decoder 26 at I/P are correctly processed.

In other words, a transmitted feedback code is embodied with a characteristic recognizable by handset decoder 26, without which recognition, handset decoder 26 will not properly respond.

A more complex security mechanism for ensuring the integrity of feedback code transmission is possible by employing the security code mechanism described herein for handset transmissions to the mainset. In other words, the mainset would have a secret or security code which would precede the feedback code, and the handset would respond to the feedback code only if the proper security code was received.

Indicator circuits

To inform the user of the condition of the automobile component, there are indicator circuits comprising LEDs and audible components.

The LED indicator circuits are responsive to outputs D0 to D3 of decoder 26 as follows. D0 controls LED 27 to signal the occurence of an unauthorized entry. D1 controls LED 28 to indicate that the engine has ceased running. D2 controls LED 29 to indicate that the signal to activate an automatic automatic garage door opener was sent. D3 controls LED 30 to indicate the completion of the engine start.

In case of unauthorized entry, the activation of LEDs 28 and 27 will be accompanied by warning sounds, produced as follows. Their activation, with the high of VT, will raise one input of AND gate 40 which controls piezo speaker 60. Two astable multivibrators, generally designated as 50, are set to periodically raise the other input of AND gate 40. Piezo speaker 60 accordingly produces a sequence of warning sounds to alert the user.

Automatic engine turnoff

Switch 84 is closed by the user to activate an automatic engine turn-off (illustrated in logic flow form in FIG. 3 and will be described next). Alternatively, switch 84 is opened to require the user to turn off the engine by manual actuation of the '2' key on keyboard 1.

Upon starting the engine, the mainset will output a feedback code to the handset. The raising of D3 will trigger timer 64. After a delay of 15 minutes, or such other delay as may be adjusted with associated conventional circuitry, timer 64 will trigger timer 65. Timer 65 triggers transistor 81, whose collector and emitter are connected to the C4 and R4 terminals of pulse generator 2 (equivalent to the manual actuation of the '*' key on keyboard 1) so that pulse generator 2 will send out the memorized security code to the mainset. Timer 65 will also simultaneously trigger timer 66, which in turn, after a delay determined by associated conventional circuitry, triggers timer 67. In turn, timer 67 activates transistor 83, which is connected to the R1 and C2 terminals of pulse generator 2 (equivalent to the manual depression of the '2' key on keyboard 1), so that the command code for turning off the engine will be sent to the mainset. In this way, the handset will have automatically turned the engine off after a preset delay.

MAINSET

Figure 6A:
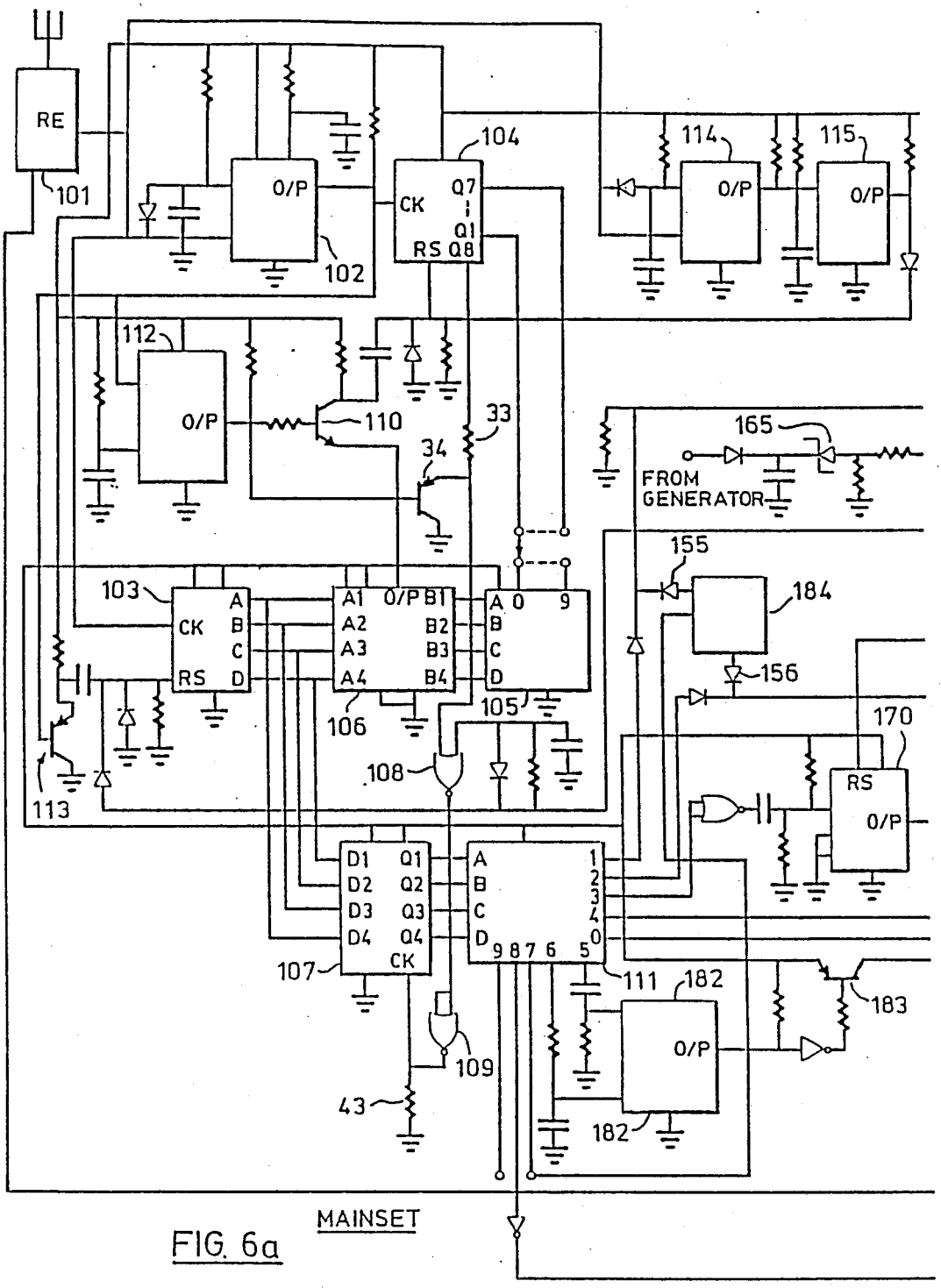
FIGS. 6*a* and 6*b*, when placed side by side are the electrical schematic diagrams of the mainset.
Figure 6B:
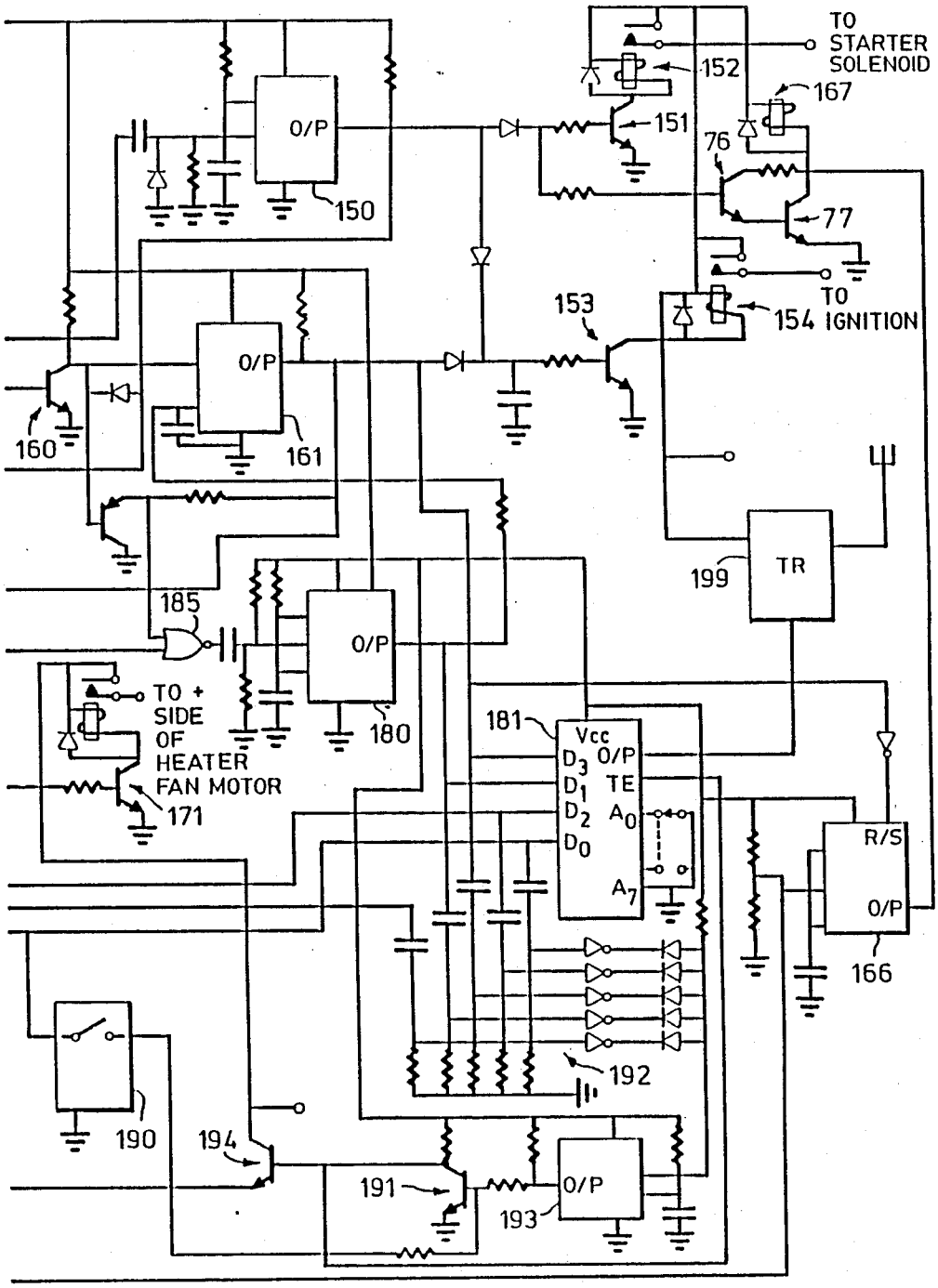

FIGS. 6*a* and 6*b*, lined up side by side, form the electrical schematic of the mainset. The alarm circuit and the automatic low temperature starter circuit of the mainset are illustrated in detail in FIGS. 7 and 8.

Reception and security code matching

With reference to FIG. 6*a*, upon receipt of a signal from handset transmitter 24, receiver 101 triggers a retriggerable one shot circuit or timer, generally designated as 102, and also triggers counter 103.

Timer 102 in turn drives a divide-by-ten counter 104 with a decoded decimal output, Q1 to Q8, of which Q1 to Q7 inputs into ten-to-four encoder 105. Encoder 105 is preset to hold the security code for a given system of handset and mainset.

The outputs of encoder 105 and counter 103 are compared in comparator 106. On a match, the output of comparator 106 keeps transistor 110 in saturation and prevents counter 103 from being reset.

Counter 103 also inputs into latch 107, which acts as a D flip flop inputting into decoder 111.

During the transmission of the first seven digits, representing the security code, Q8 of counter 104 is maintained low, and therefore NOR gates 108 and 109 connect resistor 33 with resistor 43 to keep the CK input of latch 107 low. Accordingly, latch 107 will remain in latched state and inputs D1 to D4 will not be sent to outputs Q1 to Q4.

Following the seven digit security code, the reception of the eighth digit, representing the command code, will be sent to counter 103 and then separately sent to latch 107 and to comparator 106. The eighth digit also causes timer 102 to trigger counter 104 to raise Q8. This high is sent to the clock CK input of latch 107 to unlatch it and transfer inputs D1 to D4 to outputs Q1 to Q4, and then to decoder 111.

There is a timer 112 which is triggered on the falling edge of the output of timer 102, acting through transistor 113. The output of timer 112 and the output of comparator 106 are sent to transistor 110 to determine if counter 104 should be reset. This is to ensure that comparator 106 will be activated only after completion of reception by receiver 101.

Counter 103 is reset after completion of the first code and before the second code arrives. When the second arrives, timer 102 output is changed from low to high, which resets counter 103 through transistor 113 and associated conventional circuitry. Upon reception of the first incorrect digit of a security code transmission (by accident or by unauthorized use of the handset by a user ignorant of the security code), retransmission will be required. For example, if the second digit of the security code transmission is incorrectly keyed on the handset by the user as '5' instead of '6', then counter 103 output ABCD will be high/low/high/low. Timer 102 will trigger counter 104 and Q2 thereof will go high and encoder 105 output ABCD will be low/high/low/high. Comparator 106 will accordingly output low and reset counter 104 through transistor 110.

Because any signal received after a security code match might be interpreted as a command code, a command code should be sent almost immediately after completing the transmission of the security code. To prevent accidents, a time 'window' is created, during which a signal must be sent to be accepted as a command code. There is a timer 114, with associated circuitry to create a delay (for example, three seconds). After this delay, timer 115 will be triggered to reset counter 104. A signal received after this reset will not be passed on as a command code because it will raise Q1, not Q8, of counter 104.

It will be appreciated that it is not necessary that the security code precede the command code. An alternative circuit may be constructed where the command code is transmitted first and is stored upon reception by the mainset, and the security code is transmitted second and verified, and the stored command code is then processed if there is verification.

Starting the engine

Because the command code digit for starting the engine is '1', and the output of counter 103 is sent to comparator 106, A1 to A4 thereof becomes high/low/low/low. At this time, the output ABCD of encoder 105, low/low/low/low, is sent to comparator 106 B1 to B4. Consequently, comparator 106 O-P output becomes low and resets counter 104 through transistor 110 and conventional circuitry.

When output "1" of decoder 111 goes high, associated circuitry triggers timer 150. Timer 150 may be set for 2½ seconds or some other delay as may be adjusted by conventional means. Timer 150 controls transistor 151, which in turn controls relay 152 and, therethrough, the starter solenoid.

Simultaneous with timer 150 going high, transistor 153 and relay 154 connect the ignition coil to its power source (not shown). If the engine fails to start, the voltage on the ignition coil disappears. To restart, key '1' must be actuated on keyboard 1.

Upon a successful start, the collector of transistor 160 will change from high to low to trigger timer 161. The output of timer 161 will be sent through conventional circuitry to transistor 153 so as to keep relay 154 on and maintain activation of the ignition coil. Simultaneously, timer 161 raises D3 of encoder 181, which will send a feedback code, through transmitter 199, to the handset to indicate that the engine has been started.

The lowering of the collector of transistor 160 also enables the output of timer 150 to be grounded through conventional diode circuits. Consequently, the output of terminal of timer 150 goes low and transistor 151 is cut off. In this way, the starter solenoid is disconnected after the engine has started.

The output of timer 150 also controls, through conventional circuitry, the activation of a fuel advance circuit for injecting fuel into the engine carburetor to smoothen the starting process, as will be discussed below.

On the automobile generator, VN=13 volts typically when the engine is running at full speed. There is provided a Zener diode 165 set at approximately 8 volts. When the engine has been successfully started, then VN>Vzener+the voltage across associated resistive and diode circuits, and therefore transistor 160 will conduct and trigger timer 161. The output of timer 161 is connected to the reset input of timer 170. Accordingly, the start of the engine resets timer 170, which controls the heater fan, explained next.

Activating/deactivating heater fan

The '3' output of decoder 111 goes high and triggers timer 170 through associated circuitry. The output of timer 170 will go high and turn on transistor 171 and thereby the relay for the fan motor. When the engine ceases running (i.e. VN=0), the output of timer 161 changes state, the reset input of timer 170 goes low and the fan stops. There may be connected, by conventional circuitry to the reset input of timer 170, a thermal switch mounted at a suitable location in the interior of the vehicle, which will close when the interior temperature reaches a predetermined temperature.

Turning engine off

To turn off the engine, output '2' on decoder 111, will be raised to trigger timer 180 through associated circuitry. The high output of timer 180 will turn off timer 161. This cuts off transistor 153 and relay 154 to stop the engine. Timer 180 goes high for 3 seconds (adjusted by conventional means), which raises D1 of encoder 181 for 3 seconds, which results in the appropriate handset code for the user's information.

If the engine, for any reason, ceases running during the warm-up period (i.e. VN=0), the output of timer 161 will then go high and trigger, through NOR gate 115, timer 180 to turn off timer 161, and whereby cut power to the ignition coil. As before, encoder 181 will send a code to the handset to indicate that the engine has ceased running.

Activating alarm circuit

Depression of the '5' key on the handset keyboard raises output '5' of decoder 111. This will trigger timer 182 through associated circuitry. When the output of timer 182 goes high, the base of transistor 183 will go low, through associated inverter circuits. Accordingly, transistor 183 connects a power source (not shown) to alarm circuit 190 and activates it thereby. Simultaneously, D0 of encoder 181 will be raised, so that a feedback code is sent to the handset to indicate that the alarm circuit has been activated. When an unauthorized entry occurs, alarm circuit 190 will repeatedly send a codes, via transistor 191 and associated circuitry, to power encoder 181 and thereby flash the handset indicator LEDS. Alarm circuit 190 is described in more detail below in conjunction with FIG. 7.

Activating low temperature automatic starter

There is an automatic low temperature starter circuit 184, which will be described in more detail below in conjunction with FIG. 8. The general operation is as follows . Button '7' on the handset keyboard will raise output '7' of decoder 111, which will trigger starter circuit 184. When the ambient temperature falls below a preset temperature (for example, 20° C.), starter circuit 184 will send a series of positive pulses, through associated diode circuit 155, to trigger timer 150. Afterwards, starter circuit 184 will, through associate diode circuit 156, send a pulse to NOR gate 185 to trigger timer 180. The output of timer 180 will be sent to timer 161 to turn it off, and thereby the engine. In this way, the engine will automatically be started and will run for some preset period when the temperature falls below a preset level.

Activating garage door opener

Depressing button '4' on the handset raises output '4' on decoder 111. This high will be sent to D2 of encoder 181. The output of encoder 181, which is transmitted from transmitter 199, represents the 'garage open' signal, which is received by an appropriate garage door receiver operably coupled to an automatic garage door opener (not shown). In this way, the garage door may be remotely opened. Note that the same 'garage open' signal is received by the handset receiver 25 as the feedback code indicating that the 'garage open' signal has been sent.

The garage door receiver should be equipped with appropriate receiver and decoder circuits to enable proper reception and processing of the 'garage open' signal from the mainset. If this is not possible, additional conventional circuitry may be necessary in the mainset. For example, where transmission and reception are by RF means, appropriate circuitry associated with the mainset may be necessary to tune it to the same frequency as the garage receiver when the 'garage open' signal is being sent; or to encode the 'garage open' signal separately in a way acceptable to the garage door receiver.

Activating fuel advance circuit

The best ratio of air to fuel for the engine may be about 15:1 by weight. But during the starting period, especially at cold temperatures, a richer fuel mix is desirable.

There is a fuel advance circuit organized about timer 166. The command code '8' will raise output '8' on decoder 111 on the mainset, which will trigger timer 166. Its high output provides power to transistor 76. The subsequent start engine command code '1', will activate the starter solenoid, as described before. The high of timer 150 forward biases transistor 76. Therefore, transistors 76 and 77 conduct to energize coil 167 to activate a solenoid which is part of a fuel advance circuit (not shown) to enrich the fuel mix in the carburetor of the engine.

Upon starting the engine, timer 161 will output high, and, through conventional inverter circuits, reset timer 166. Once reset, the output of timer 166 goes low and transistors 76 and 77 go off, and the fuel advance circuit will then be closed. This will ensure that the fuel advance circuit is functional only at the start of the engine and not thereafter.

Obtaining automobile condition

The condition of the prescribed options of the automobile may be obtained by the user by actuation of the '0' button on the handset. Accordingly, the '0' output of decoder 111 will be raised, which will enable encoder 181 to send codes to the handset according to the status of the D0 to D3 inputs of encoder 181, as follows.

As discussed before, the preset levels of A0 to A7 of encoder 181 give the feedback code a characteristic which will enable handset decoder 26 to properly process the received feedback code. When the TE (transmit enable) input of encoder 181 is low, the O/P output will send signals, representing the inputs of encoder 181, to transmitter 199. The O/P output will cease outputting when TE goes high. When any of D0 to D3 of encoder 181 goes from low to high, a positive pulse will be generated by conventional circuitry, generally designated as 192, to timer 193. Thus triggered, timer 193 will send a high to transistor 191. The collector of transistor 191 goes low, which lowers TE of encoder 181, and accordingly, the output terminal of encoder 181 starts to send data corresponding to D0 to D3. The timing period of timer 193 is adjustable by associated circuitry.

When transmitter 199 is transmitting, the collector of transistor 191 is low, which keeps the base of transistor 194 low. Transistor 194 is cut off, and accordingly, receiver 101 is not powered and will not receive while transmitter 199 is transmitting.

Alarm circuit

Figure 7:
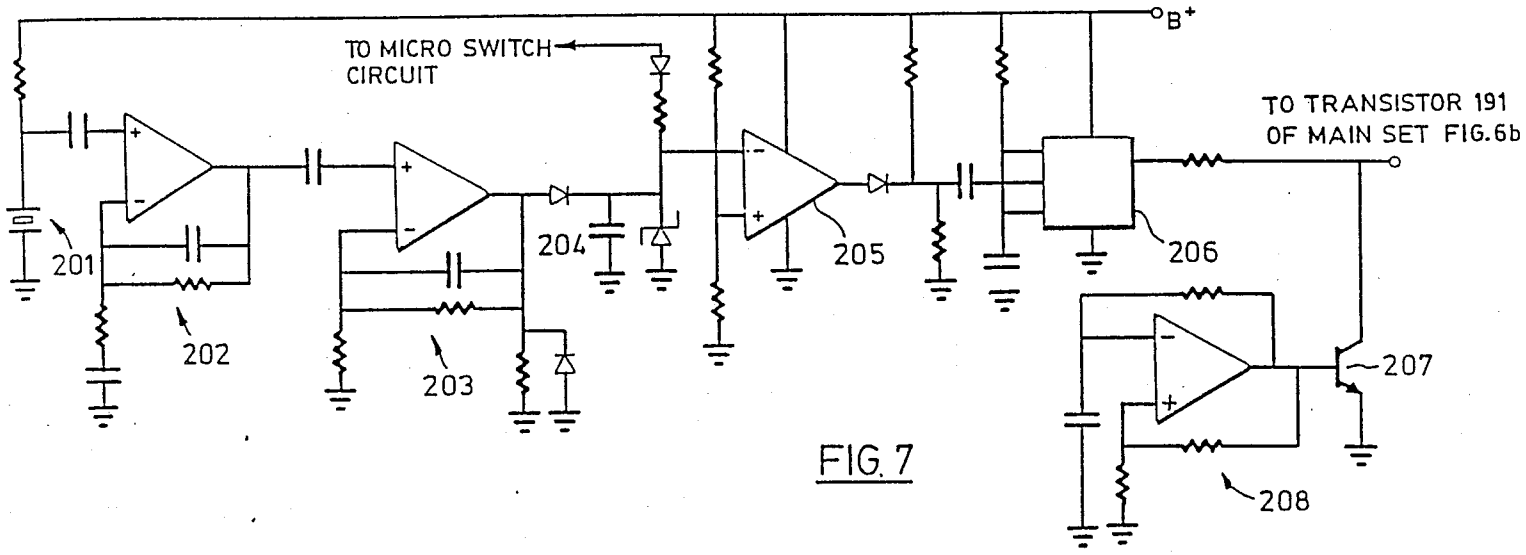
FIG. 7 is an electrical schematic diagram of the alarm circuit of the mainset.

With reference to FIG. 7, the alarm circuit, generally designated as 190 in FIG. 6, for detecting unauthorized entry or tampering, is now described in more detail.

Unauthorized entry or tampering are usually attended by vibrations and noises. Signals generated by piezo sensor 201 pass through two bandpass filters, generally designated as 202 and 203, and are rectified by a diode and capacitor circuit, generally designated as 204. In this way, selected noises will be detected. The rectified signal at one input of comparator 205 will change its output to trigger timer 206, which powers transistor 207.

There is an astable multivibrator circuit, generally designated as 208. When piezo sensor detects noise, timer 206 powers transistor 207. At this moment, if the output from multivibrator circuit 208 is low, the collector of transistor 207 will go high. This high will be sent to base of transistor 191 of FIG. 6. Accordingly, TE of encoder 181 goes low and data is sent by encoder 181 to transmitter 199. This 'flashing' of the status indicators on the handset serves to inform the user of the unauthorized entry.

Alternatively, or supplementary to the piezo sensor, there may be a microswitch suitably mounted in the automobile which is closed when a door is opened or when the automobile's courtesy light circuit is activated (not shown). The closing of the microswitch will cause the output of comparator 205 to go low and trigger timer 206. This may be effected by conventional circuitry connected to the alarm circuit at said input to comparator 205. Similarly, there may be a sensor which detects the engagement of the automobile's transmission into a gear other than 'park', or a motion detector.

Upon detection of an unathorized entry, by one or several of such conditions, the automobile headlights may be automatically flashed, the horn may be activated, the ignition circuit may be disconnected; all through conventional circuits connected to the appropriate electrical terminals of those automobile components (not shown).

Low temperature automatic starter circuit

Figure 8:
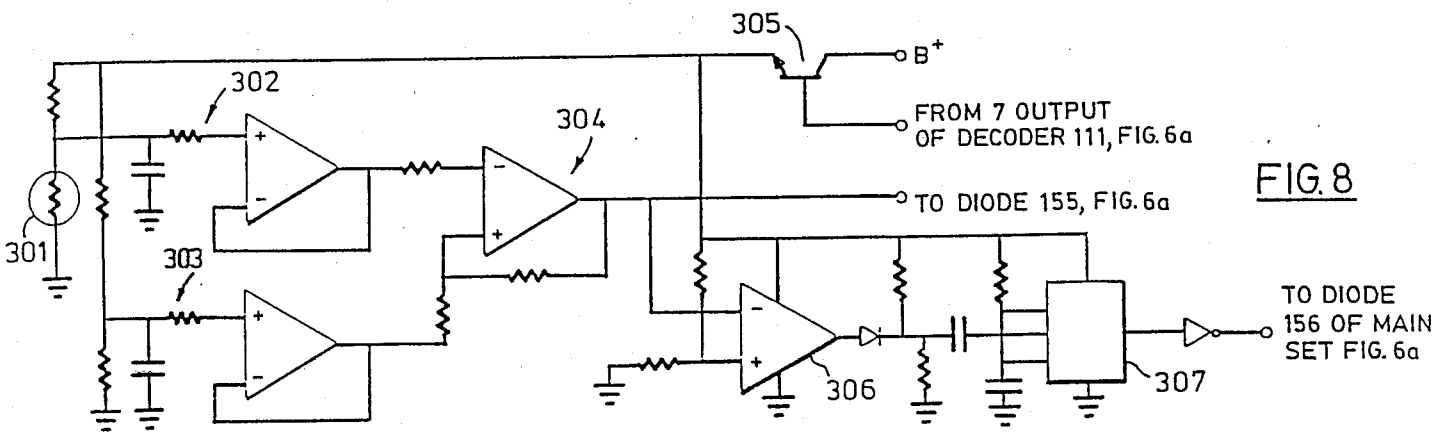
FIG. 8 is an electrical schematic diagram of the automatic low temperature starter circuit of the mainset.

With reference to FIG. 8, the low temperature starter, generally designated as 184 in FIG. 6, is now described in more detail. When the '7' output of decoder 111 goes high in FIG. 6, transistor 305 conducts to connect the B+power source to power this circuit. There is a thermostat 301 or similar device responsive to the ambient temperature or the temperature of the automobile), and emitter follower circuits, generally designated as 302 and 303. The output of emitter follower 303 will be the reference voltage to Schmitt trigger circuit, generally designated as 304. When the monitored temperature falls below a preset temperature (for example, −20° C.), the output of emitter follower 302 will drop sufficiently to trigger Schmitt trigger 304. The high output will be sent to diode 155 on FIG. 6 to start the engine, as if the '1' output of decoder 111 had been raised, described above.

The output from Schmitt trigger 304 makes the output of comparator 306 go from high to low. Timer 307 then outputs high, which is inverted. Timer 307, after a delay of 15 minutes, or such other delay as set by associated circuitry, changes its state. This high is then sent to diode 156 of FIG. 6 to turn off the engine as if the '2' output of decoder 111 has been raised. Accordingly, the engine is turned off.

Components found suitable for the electrical circuits described include: timers—Signetics NE555, NE558 and NE556, dividers—RCA CD4017, counters—RCA CD4518, comparator—RCA CD4063, encoder—RCA CD40147, latch—RCA CD4042, decoder—RCA CD4028, encoder 181 Holtek Semiconductor Inc. HT-12E, decoder 26—Holtek Semiconductor Inc. HT-12D, pulse generator—United Microelectronics Corp. UM91603C.

The construction of the associated circuitry illustrated in the Figures or referred to in the disclosure herein but not explicitly identified or described, is within the capability of one of ordinary skill in the art.

Whether used for an automobile or for engine driven devices in industrial settings, the invention may be associated with override controls for automatically halting operation of the engine under externally prescribed conditions, or remotely by the user when an appropriate feedback code is received. In addition to those mentioned in conjunction with the alarm circuit, such conditions may include fluid pressure, moisture content, a low fuel tank, the incline of the automobile (for example, parked on a slope), level of engine emissions, engine speed, and the like. For example, where the automobile is in an enclosed environment, the engine might be shut off automatically if an ambient carbon monoxide sensor registered above a preset level.

It will be apparent to those skilled in the art that the above-described embodiment is merely illustrative of the principles of the present invention. Numerous other embodiments may be devised without departing from the scope of the invention, as defined in the following claims.

What I claim as my invention is:

1. A system for remotely controlling a component of a vehicle, the system comprising a remote controller operable by a user, and a mainset mounted at any suitable location on the vehicle, to be controlled by said remote controller, wherein said remote controller includes:

(a) remote controller code generating means for generating a remote controller command code for controlling the vehicle component, said command code having a characteristic;

(b) remote controller transmission means, responsive to said remote controller code generating means, for transmitting said remote controller command code to said mainset;

(c) remote controller reception means for receiving a feedback code transmitted from said mainset, indicative of the condition of the vehicle component controlled in accordance with said command code;

(d) remote controller indicator means, responsive to said remote controller reception means and to said transmitted feedback code, for providing the user an indication correlatable with said transmitted feedback code;

and wherein said mainset includes (a) mainset reception means for receiving said command code transmitted from said remote controller transmission means;

(b) mainset security means, responsive to said mainset reception means, having a mainset characteristic, for producing a verification that said command code characteristic matches said mainset characteristic;

(c) mainset implementation means, responsive to said verification and said mainset reception means, and coupled to the vehicle component, for implementing the control function on the vehicle component in accordance with said command code;

(d) mainset feedback means, coupled to the vehicle component, for generating said feedback code indicative of the condition of the vehicle component following the implementation of said command code; and (e) mainset transmission means, responsive to said mainset feedback means, for transmitting said feedback code to said remote controller reception means, said mainset feedback means having means for generating said feedback code with a characteristic and said remote controller having security means, responsive to said remote controller reception means and coupled to said remote controller indicator means, said remote controller security means having (i) a remote controller characteristic, (ii) means for producing a verification that said transmitted feedback code characteristic matches said remote controller characteristic, and (iii) means for rendering said remote controller indicator means unresponsive to said transmitted feedback code if there is no verification.

2. A system according to claim 1, wherein said command code characteristic is a security code and said mainset characteristic is a security code.

3. A system according to claim 1, wherein said feedback code characteristic is a security code and said remote controller characteristic is a security code.

4. A system according to claim 3, wherein said command code characteristic is a security code and said mainset characteristic is a security code.

5. A system according to claim 1, wherein said command code characteristic is a sequence of pulses modulated in a predetermined method, and said mainset characteristic is a demodulation of a sequence of pulses in a predetermined method.

6. A system according to claim 1, wherein said feedback code characteristic is a sequence of pulses modulated in a predetermined method, and said remote controller characteristic is a demodulation of a sequence of pulses in a predetermined method.

7. A system according to claim 6, wherein said command code characteristic is a sequence of pulses modulated in a predetermined method, and said mainset characteristic is a demodulation of a sequence of pulses in a predetermined method.

8. A system according to claims 1, 2 or 3, wherein said mainset security means has a timing means, responsive to said mainset reception means, for measuring a time interval from the reception by said mainset reception means of said transmitted command code and for disabling said mainset reception means if said time interval measured exceeds a predetermined time period.

9. A system according to claims 4, 5 or 6, wherein said mainset security means has a timing means, responsive to said mainset reception means, for measuring a time interval from the reception by said mainset reception means of said transmitted command code and for disabling said mainset reception means if said time interval measured exceeds a predetermined time period.

10. A system according to claims 1, 2 or 3, wherein said remote controller further comprises:

(a) timing means, responsive to the reception of said transmitted feedback code by said remote controller reception means, for measuring a time interval; and (b) automatic shutoff means, coupled to said remote controller transmission means and responsive to said timing means when said time interval measured exceeds a predetermined time period, for generating a command code for deactivating the vehicle component, for automatic transmission by said remote controller transmission means.

11. A system according to claims 4, 5 or 6, wherein said remote controller further comprises:

(a) timing means, responsive to the reception of said transmitted feedback code by said remote controller reception means, for measuring a time interval; and (b) automatic shutoff means, coupled to said remote controller transmission means and responsive to said timing means when said time interval measured exceeds a predetermined time period, for generating a command code for deactivating the vehicle component, for automatic transmission by said remote controller transmission means.

12. A system for remotely controlling a component of a device having an engine, the system comprising a remote controller operable by a user, and a mainset mounted at any suitable location on the device, to be controlled by said remote controller, wherein said remote controller includes:

(a) remote controller code generating means for generating a remote controller command code for controlling the device component, said command code having a characteristic;

(b) remote controller tramsmission means, responsive to said remote controller code generating means, for transmitting said remote controller command code to said mainset;

(c) remote controller reception means for receiving a feedback code transmitted from said mainset, indicative of the condition of the device component controlled in accordance with said command code;

(d) remote controller indicator means, responsive to said remote controller reception means and to said transmitted feedback code, for providing the user an indication correlatable with said transmitted feedback code; and wherein said mainset includes (a) mainset reception means for receiving said command code transmitted from said remote controller transmission means;

(b) mainset security means, responsive to said mainset reception means, having a mainset characteristic, for producing a verification that said command code characteristic matches said mainset characteristic;

(c) mainset implementation means, responsive to said verification and said mainset reception means, and coupled to the device component, for implementing the control function on the device component in accordance with said command code;

(d) mainset feedback means, coupled to the device compolnent, for generating said feedback code indicative of the condition of the device component following the implementation of said command code; and (e) mainset transmission means, responsive to said mainset feedback means, for transmitting said feedback code to said remote controller reception means, said mainset feedback means having means for generating said feedback code with a characteristic and said remote controller having security means, responsive to said remote controller reception means and coupled to said remote controller indicator means, said remote controller security means having (i) a remote controller characteristic, (ii) means for producing a verification that said transmitted feedback code characteristic matches said remote controller characteristic, and (iii) means for rendering said remote controller indicator means unresponsive to said transmitted feedback code if there is no verification.

13. A system according to claim 12, wherein said command code characteristic is a security code and said mainset characteristic is a security code.

14. A system according to claim 12, wherein said feedback code characteristic is a security code and said remote controller characteristic is a security code.

15. A system according to claim 14, wherein said command code characteristic is a security code and said mainset characteristic is a security code.

16. A system according to claim 12, wherein said command code characteristic is a sequence of pulses modulated in a predetermined method, and said mainset characteristic is a demodulation of a sequence of pulses in a predetermined method.

17. A system according to claim 12, wherein said feedback code characteristic is a sequence of pulses modulated in a predetermined method, and said remote controller characteristic is a demodulation of a sequence of pulses in a predetermined method.

18. A system according to claim 17, wherein said command code characteristic is a sequence of pulses modulated in a predetermined method, and said mainset characteristic is a demodulation of a sequence of pulses in a predetermined method.

19. A system according to claims 12, 13, 14 or 15, wherein said mainset security means has a timing means, responsive to said mainset reception means, for measuring a time interval from the reception by said mainset reception means of said transmitted command code and for disabling said mainset reception means if said time interval measured exceeds a predetermined time period.

20. A system according to claims 16, 17 or 18, wherein said mainset security means has a timing means, responsive to said mainset reception means, for measuring a time interval from the reception by said mainset reception means of said transmitted command code and for disabling said mainset reception means if said time interval measured exceeds a first predetermined time period.

21. A system according to claims 13 or 14, wherein said remote controller further comprises:

(a) timing means, responsive to the reception of said transmitted feedback code by said remote controller reception means, for measuring a time interval; and (b) automatic shutoff means, coupled to said remote controller transmission means and responsive to said second timing when said time interval measured exceeds a predetermined time period, for generating a command code for deactivating the device component, for automatic transmission by said remote controller transmission means.

22. A system according to claims 16, 17 or 18, wherein said remote controller further comprises:

(a) timing means, responsive to the reception of said transmitted feedback code by said remote controller reception means, for measuring a time interval; and (b) automatic shutoff means, coupled to said remote controller transmission means and responsive to said timing means when said time interval measured exceeds a predetermined time period, for generating a command code for deactivating the device component, for automatic transmission by said remote controller transmission means.

23. A system for remotely controlling a component of a vehicle, the system comprising a remote controller operable by a user, and a mainset mounted at any suitable location on the vehicle, to be controlled by said remote controller, wherein said remote controller includes:

(a) remote controller code generating means for generating a remote controller command code for controlling the vehicle component, said command code having a characteristic;

(b) remote controller transmission means, responsive to said remote controller code generating means, for transmitting said remote controller command code to said mainset;

(c) remote controller reception means for receiving a feedback code transmitted from said mainset, indicative of the condition of the vehicle component controlled in accordance with said command code;

(d) remote controller indicator means, responsive to said remote controller reception means and to said transmitted feedback code, for providing the user an indication correlatable with said transmitted feedback code;

and wherein said mainset includes (a) mainset reception means for receiving said command code transmitted from said remote controller transmission means;

(b) mainset security means, responsive to said mainset reception means, having a mainset characteristic, for producing a verification that said command code characteristic matches said mainset characteristic;

(c) mainset implementation means, responsive to said verification and said mainset reception means, and coupled to the vehicle component, for implementing the control function on the vehicle component in accordance with said command code;

(d) mainset feedback means, coupled to the vehicle component, for generating said feedback code indicative of the condition of the vehicle component following the implementation of said command code; and (e) mainset transmission means, responsive to said mainset feedback means, for transmitting said feedback code to said remote controller reception means, said mainset security means having a timing means, responsive to said mainset reception means, for measuring a time interval from the reception by said mainset reception means of said transmitted command code and for disabling said mainset reception means if said time interval measured exceeds a predetermined time period.

24. A system according to claim 23, wherein said command code characteristic is a security code and said mainset characteristic is a security code.

25. A system according to claim 23, wherein said command code characteristic is a sequence of pulses modulated in a predetermined method, and said mainset characteristic is a demodulation of a sequence of pulses in a predetermined method.

26. A system for remotely controlling a component of a vehicle, the system comprising a remote controller operable by a user, and a mainset mounted at any suitable location on the vehicle, to be controlled by said remote controller, wherein said remote controller includes:

(a) remote controller code generating means for generating a remote controller command code for controlling the vehicle component, said command code having a characteristic;

(b) remote controller transmission means, responsive to said remote controller code generating means, for transmitting said remote controller command code to said mainset;

(c) remote controller reception means for receiving a feedback code transmitted from said mainset, indicative of the condition of the vehicle component controlled in accordance with said command code;

(d) remote controller indicator means, responsive to said remote controller reception means and to said transmitted feedback code, for providing the user an indication correlatable with said transmitted feedback code;

(e) timing means, responsive to the reception of said transmitted feedback code by said remote controller reception means, for measuring a time interval; and (f) automatic shutoff means, coupled to said remote controller transmission means and responsive to said timing means when said time interval measured exceeds a predetermined time period, for generating a command code for deactivating the vehicle component, for automatic transmission by said remote controller transmission means;

and wherein said mainset includes (a) mainset reception means for receiving said command code transmitted from said remote controller transmission means;

(b) mainset security means, responsive to said mainset reception means, having a mainset characteristic, for producing a verification that said command code characteristic matches said mainset characteristic;

(c) mainset implementation means, responsive to said verification and said mainset reception means, and coupled to the vehicle component, for implementing the control function on the vehicle component in accordance with said command code;

(d) mainset feedback means, coupled to the vehicle component, for generating said feedback code indicative of the condition of the vehicle component following the implementation of said command code; and (e) mainset transmission means, responsive to said mainset feedback means, for transmitting said feedback code to said remote controller reception means.

27. A system according to claim 26, wherein said command code characteristic is a security code and said mainset characteristic is a security code.

28. A system according to claim 26, wherein said command code characteristic is a sequence of pulses modulated in a predetermined method, and said mainset characteristic is a demodulation of a sequence of pulses in a predetermined method.

29. A system for remotely controlling a component of a device having an engine, the system comprising a remote controller operable by a user, and a mainset mounted at any suitable location on the device, to be controlled by said remote controller, wherein said remote controller includes:

(a) remote controller code generating means for generating a remote controller command code for controlling the device component, said command code having a characteristic;

(b) remote controller transmission means, responsive to said remote controller code generating means, for transmitting said remote controller command code to said mainset;

(c) remote controller reception means for receiving a feedback code transmitted from said mainset, indicative of the condition of the device component controlled in accordance with said command code;

(d) remote controller indicator means, responsive to said remote controller reception means and to said transmitted feedback code, for providing the user an indication correlatable with said transmitted feedback code;

and wherein said mainset includes (a) mainset reception means for receiving said command code transmitted from said remote controller transmission means;

(b) mainset security means, responsive to said mainset reception means, having a mainset characteristic, for producing a verification that said command code characteristic matches said mainset characteristic;

(c) mainset implementation means, responsive to said verification and said mainset reception means, and coupled to the device component, for implementing the control function on the device component in accordance with said command code;

(d) mainset feedback means, coupled to the device compolnent, for generating said feedback code indicative of the condition of the device component following the implementation of said command code; and (e) mainset transmission means, responsive to said mainset feedback means, for transmitting said feedback code to said remote controller reception means, said mainset security means having a timing means, responsive to said mainset reception means, for measuring a time interval from the reception by said mainset reception means of said transmitted command code and for disabling said mainset reception means if said time interval measured exceeds a predetermined time period.

30. A system according to claim 29, wherein said command code characteristic is a security code and said mainset characteristic is a security code.

31. A system according to claim 29, wherein said command code characteristic is a sequence of pulses modulated in a predetermined method, and said mainset characteristic is a demodulation of a sequence of pulses in a predetermined method.

32. A system for remotely controlling a component of a device having an engine, the system comprising a remote contoller operable by a user, and a mainset mounted at any suitable location on the device, to be controlled by said remote controller, wherein said remote controller includes:

(a) remote controller code generating means for generating a remote controller command code for controlling the device component, said command code having a characteristic;

(b) remote controller transmission means, responsive to said remote controller code generating means, for transmitting said remote controller command code to said mainset;

(c) remote controller reception means for receiving a feedback code transmitted from said mainset, indicative of the condition of the device component controlled in accordance with said command code;

(d) remote controller indicator means, responsive to said remote controller reception means and to said transmitted feedback code, for providing the user an indication correlatable with said transmitted feedback code;

(e) timing means, responsive to the reception of said transmitted feedback code by said remote controller reception means, for measuring a time interval; and (b) automatic shutoff means, coupled to said remote controller transmission means and responsive to said timing means when said time interval measured exceeds a predetermined time period, for generating a command code for deactivating the device component, for automatic transmission by said remote controller transmission means;

and wherein said mainset includes (a) mainset reception means for receiving said command code transmitted from said remote controller transmission means;

(b) mainset security means, responsive to said mainset reception means, having a mainset characteristic, for producing a verification that said command code characteristic matches said mainset characteristic;

(c) mainset implementation means, responsive to said verification and said mainset reception means, and coupled to the device component, for implementing the control function on the device component in accordance with said command code;

(d) mainset feedback means, coupled to the device compolnent, for generating said feedback code indicative of the condition of the device component following the implementation of said command code; and (e) mainset transmission means, responsive to said mainset feedback means, for transmitting said feedback code to said remote controller reception means.

33. A system according to claim 32, wherein said command code characteristic is a security code and said mainset characteristic is a security code.

34. A system according to claim 32, wherein said command code characteristic is a sequence of pulses modulated in a predetermined method, and said mainset characteristic is a demodulation of a sequence of pulses in a predetermined method.

* * * * *